US005757285A

United States Patent [19]

Grabow et al.

[11] Patent Number: 5,757,285

[45] Date of Patent: May 26, 1998

[54] METHOD AND APPARATUS FOR EFFECTING A WIRELESS EXCHANGE OF DATA BETWEEN A STATIONARY STATION AND MOVING OBJECTS

[75] Inventors: Wilhelm Grabow, Nordstemmen; Felix Dobias, Paderborn-Dahl, both of Germany

[73] Assignee: Robert Bosch GmbH, Stuttgart, Germany

[21] Appl. No.: 764,673

[22] Filed: Dec. 11, 1996

Related U.S. Application Data

[63] Continuation of Ser. No. 252,461, Jun. 1, 1994, abandoned.

[30] Foreign Application Priority Data

Jun. 1, 1993 [DE] Germany ..... 43 18 109.0

[51] Int. Cl.[6] ..... G08G 1/00

[52] U.S. Cl. ..... 340/928; 340/905; 340/825.5; 364/436; 364/438; 455/507; 455/517; 342/380

[58] Field of Search ..... 340/928, 905, 340/825.5; 235/384, 385; 364/436, 438; 455/517, 507; 342/380, 383, 373, 457

[56] References Cited

U.S. PATENT DOCUMENTS

| | | | |
|---|---|---|---|
| 4,070,675 | 1/1978 | Daniel et al. | 342/380 |
| 4,298,872 | 11/1981 | Rodgers | 342/380 |
| 4,316,192 | 2/1982 | Acoraci | 343/100 SA |
| 5,144,553 | 9/1992 | Hassett et al. | 340/928 |
| 5,406,275 | 4/1995 | Hassett et al. | 340/933 |
| 5,424,727 | 6/1995 | Shieh | 340/928 |
| 5,510,796 | 4/1996 | Applebaum | 342/162 |
| 5,543,806 | 8/1996 | Wilkinson | 342/368 |

FOREIGN PATENT DOCUMENTS

| | | |
|---|---|---|
| 0 002 469 | 6/1979 | European Pat. Off. . |
| 0 401 192 | 12/1990 | European Pat. Off. . |
| 0 407 243 | 1/1991 | European Pat. Off. . |
| 0 416 692 | 3/1991 | European Pat. Off. . |
| 0 472 018 | 2/1992 | European Pat. Off. . |
| 0 567 889 | 11/1993 | European Pat. Off. . |
| 0 578 060 | 1/1994 | European Pat. Off. . |
| 0 585 718 | 3/1994 | European Pat. Off. . |
| 0 588 045 | 3/1994 | European Pat. Off. . |
| 41 07 803 | 9/1992 | Germany . |
| 4107803 | 9/1992 | Germany . |

OTHER PUBLICATIONS

Komanecky et al., IVHS Applications of Smart Cards, Society of Automotive Engineers, Inc., Oct. 1, 1991; pp. 977–987.

*Primary Examiner*—Jeffery Hofsass
*Assistant Examiner*—Julie B. Lieu
*Attorney, Agent, or Firm*—Kenyon & Kenyon

[57] ABSTRACT

A method for effecting a wireless exchange of data between a stationary station and transmitter/receivers on board objects, particularly vehicles moving relative to the stationary station. The reception profiles of an antenna array having a plurality of receiving antennas is directed electronically onto an object. The transmitter/receivers on the object transmit, in response to the received signal, an answer signal having the same carrier frequency as the signal received and having a level which is proportional to the level of the signal received. In the antenna array, a transmitting antenna is associated with each receiving antenna, and the transmitting antenna sends out signals having a transmission profile which corresponds to the reception profile of the receiving antenna. The damping factors of transmission profile and reception profile are thereby multiplied by each so that two relatively simple circuits are necessary in order to achieve a desired high side-lobe damping.

7 Claims, 4 Drawing Sheets

METHOD AND APPARATUS FOR EFFECTING A WIRELESS EXCHANGE OF DATA BETWEEN A STATIONARY STATION AND MOVING OBJECTS

This is a continuation of application Ser. No. 08/252,461 filed on Jun. 1, 1994, now abandoned.

FIELD OF THE INVENTION

The present invention relates to a method for effecting a wireless exchange of data between a stationary station and transmitter/receivers on-board objects, particularly vehicles travelling in lanes relative to the stationary station.

BACKGROUND OF THE INVENTION

German Patent Application No. 41 07 803 describes a system for the automatic payment of tolls from a moving vehicle. Every vehicle which has to pay a toll is provided with an automatic debiting device which cooperates with a transmitter/receiver on the vehicle. An exchange of data takes place between the stationary station and the transmitter/receiver. The debiting device posts the toll and then sends an acknowledgement of it to the stationary station. During this process, a reception profile for the vehicle is produced with antenna elements of the antennas of the stationary station. The reception profile can follow the moving vehicle as follows: The transmitter/receivers on the vehicles preferably operate as transponders which return the signal received from the stationary station in modulated form. Accordingly, the response signal has the same carrier frequency as the signal sent out by the stationary station. Furthermore, its level is proportional to the level of the signal received.

In order to mask out signals corresponding to other vehicles, the receiving antenna must be so designed that, for instance, only one vehicle of the stationary station can stay within its corresponding radiation region. The directional properties of the receiving antenna must provide assurance that there is a strong damping of signals outside the desired radiation zone in order to avoid incorrect attribution of the signals of adjacent vehicles. The reduction of the signals outside the major lobe of the antenna, in practice, amounts, for instance, to 40 dB. In order to achieve this damping value, the receiving antenna must be equipped with a large number of antenna elements, thereby increasing the cost of the system significantly.

As such, a need exists for a system which reduces the cost of the compression of side lobes.

SUMMARY OF THE INVENTION

In accordance with the present invention, a transmitting antenna is associated with each receiving antenna, and the transmitting antenna sends out signals which have a transmission profile which corresponds to the reception profile of the receiving antenna.

In known methods, the damping of side lobes is effected exclusively by the reception profile of the receiving antenna, and broad-radiating transmitting antennas which cover several vehicles are utilized. In the method according to the present invention, however, several transmitting senders are provided which send out their signals with a transmission profile which corresponds to the reception profile of the corresponding receiving antenna. Since the transmitter/receivers on other potentially disturbing moving objects also send back (in accordance with the transponder principle) the signals which have been sent out, signals which have already been strongly damped by the transmission profile are sent back to the stationary station with the low signal level resulting therefrom and are again damped by the reception profile so that the dampings of transmission profile and reception profile are multiplied. When the transmission profile and the reception profile agree with each other, a damping value of, for instance, −40 dB is obtained such that the corresponding damping of the side lobes in the transmission profile and in the reception profile is −20 dB each. These damping values can be obtained with substantially simpler antenna arrangements.

In accordance with a further embodiment of the present invention, a transmission antenna is associated in the stationary station with each receiving antenna, and both the receiving antenna and the transmitting antenna have a beam-forming network. In accordance with a still further embodiment of the present invention, transmitting and receiving antennas which are associated with each other are arranged in the direct vicinity in space of each other, and the beam-forming networks of the antennas associated with each other are controlled by the same processor.

Since a plurality of transmitting antennas are provided in accordance with the present invention, the influence of disturbing signals can be effectively reduced by adjacent transmitting antennas sending out signals on different carrier frequencies. Only signals on the frequency of the corresponding transmitting senders are forwarded for evaluation by the corresponding receiving antennas.

When a carrier frequency channel in the frequency range of 5.8 GHz is used, it is advisable to provide four channels with a band width of 5 MHz.

DETAILED DESCRIPTION OF THE INVENTION

Figure 1:
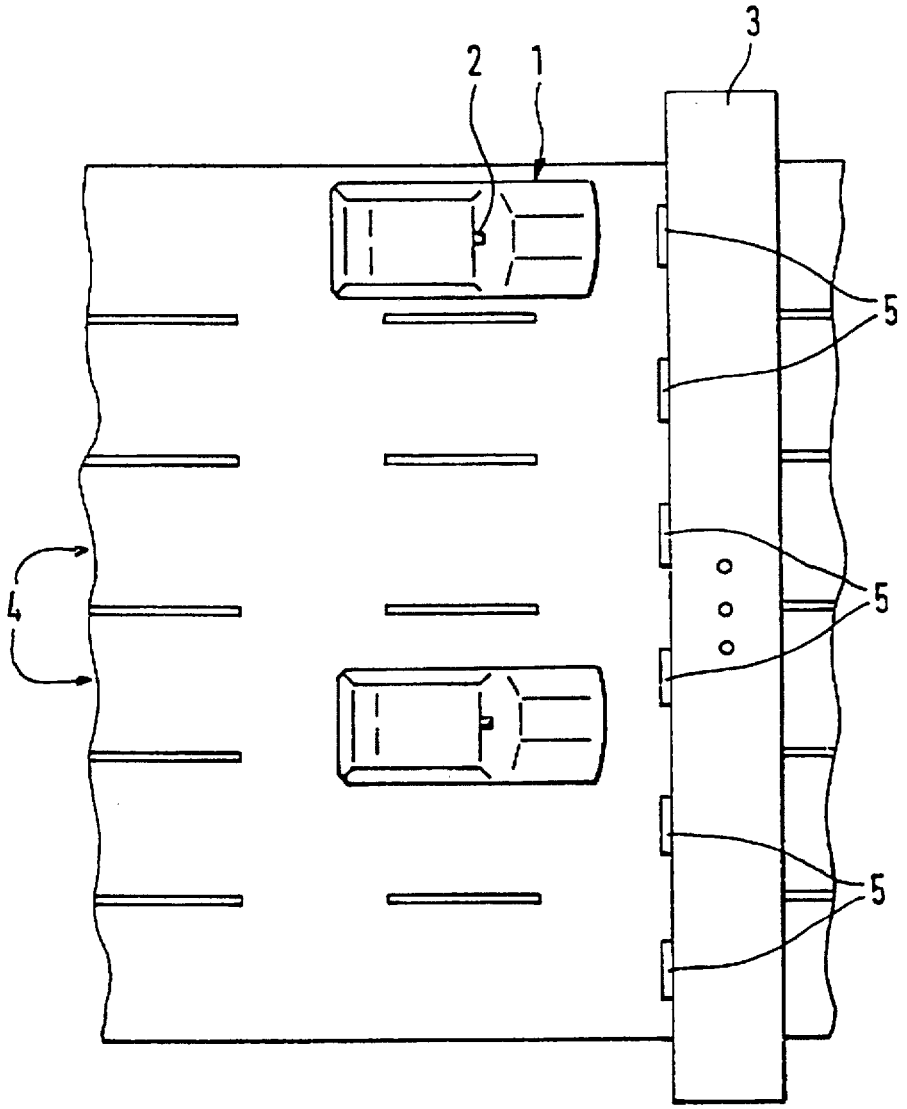
FIG. 1 shows a stationary station having several antennas and vehicles which are approaching the stationary station.

FIG. 1 shows vehicles 1, each of which is provided with a transmitter/receiver 2, in front of a stationary station 3 which spans over travel lanes 4 of a road. The stationary station has an antenna array with several antennas 5, a transmitting and receiving antenna 5 being provided, for instance, for each lane 4.

Figure 2:
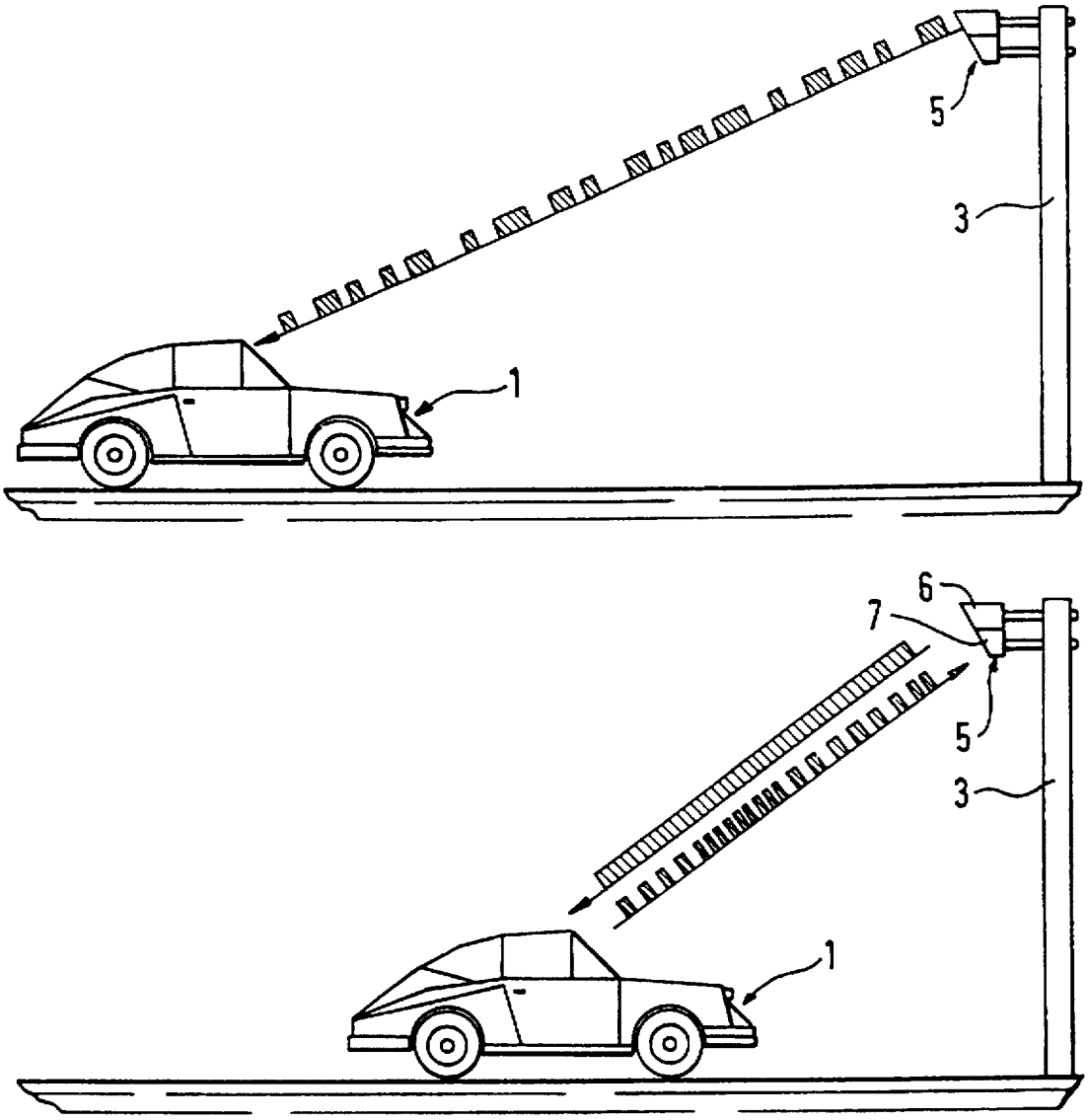
FIG. 2 illustrates communication between the stationary station and one of the vehicles.

Communication between the stationary station and the vehicle 1 is illustrated in FIG. 2. At the start of the exchange of data, a signal is transmitted to the vehicle 1 from the stationary station 3 via the transmission part of the antenna 5. The transmitter/receiver 2 of the vehicle 1 can thereby be activated. In addition, data is transmitted from the stationary station 3 to the vehicle 1. The debiting of the amount of the toll is effected by the transmitter/receiver 2, as shown in the lower part of FIG. 2. An acknowledgement signal is then sent out by the transmitter/receiver 2 of the vehicle 1 to the stationary station 3 as follows: a signal having a continuous level is sent out from a transmission part 6 of the antenna 5 to the transmitter/receiver 2. This signal then passes from the transmitter/receiver 2, which is formed by a transponder, as a modulated signal to a reception part 7 of the antenna 5.

If a proper acknowledgement signal is not received by the antenna 5, suitable measures can be initiated which make it possible to identify the vehicle 1 for subsequent collection of the toll, for example by storing a picture of the vehicle or the like.

Figure 3:
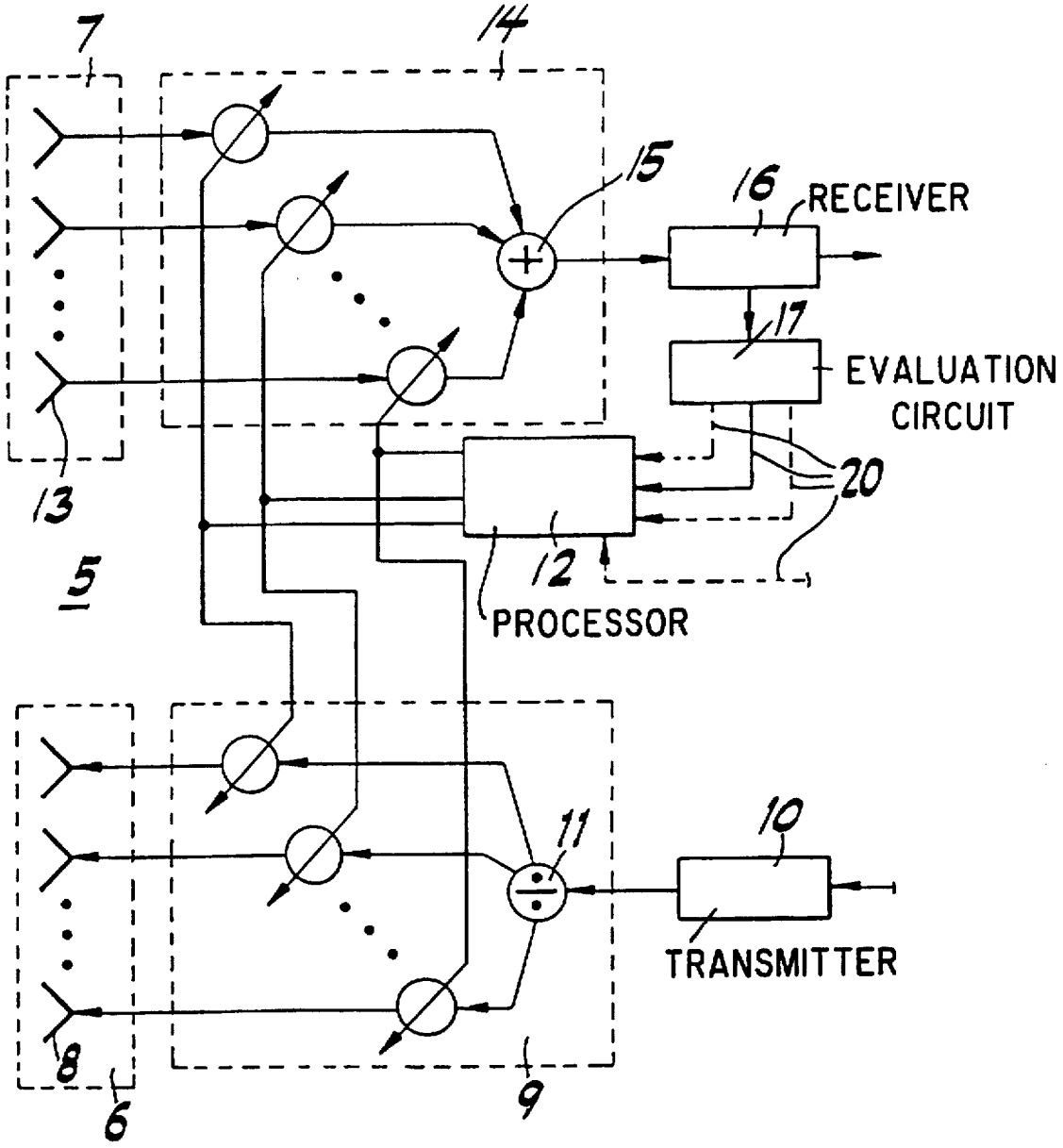
FIG. 3 shows the development of a receiving antenna and a transmitting antenna having beam-forming networks.

FIG. 3 shows the construction of an antenna 5 with its transmitting part 6 and receiving part 7. The transmitting part 6 contains a plurality of transmitting antenna elements 8, which are supplied, via a beam-forming network 9, with the output signal of a transmitter 10 over a division circuit 11. In the beam-forming network 9, the individual signals, which are weighted differently, are conducted to the transmitting-antenna elements 8 which are distributed in space. The weighing of the individual signals is established by a processor 12. As a result of this different vectorial weighing, a transmission profile of the transmission part 6 of the antenna 5 is produced.

Similarly, the reception part 7 of the antenna 5 has a plurality of reception antenna elements 13 which are connected to a receiver 16 via a beam-forming network 14 and a summing circuit 15. Due to the weighing within the beam-forming network 14, which is controlled by the processor 12, a three-dimensional distribution of sensitivity is effected in the form of a reception profile. An evaluation circuit 17 is coupled to the receiver 16 and provides a variety of information 20 which can be used by the processor 12 to establish suitable transmission and reception profiles. The processor 12 can furthermore receive information, for example, via the weighing distribution of antennas 5 adjacent to beam-forming networks 9, 14.

In accordance with the embodiment according to the present invention shown in FIG. 3, the number and arrangement of the transmission antenna elements 8 is the same as the number and arrangement of the reception transmission elements 13. Transmission part 6 and reception part 7 are arranged in direct vicinity in space so that the beam-forming networks 9, 14 receive the same weighing vectors from the processor 12.

Figure 4A:
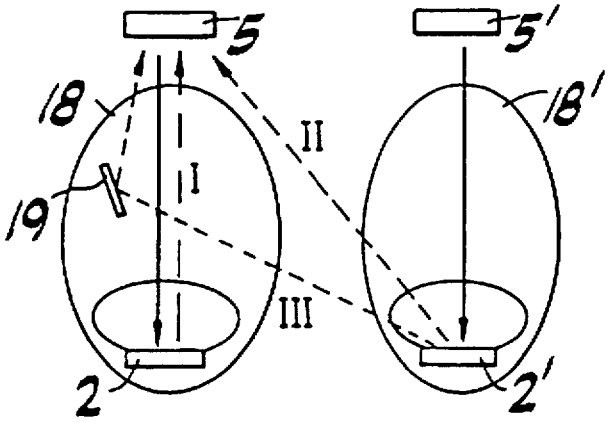
FIG. 4*a* shows radiation regions for two transmitter/receiver antennas with possible error influences when using the same carrier frequency.
Figure 4B:
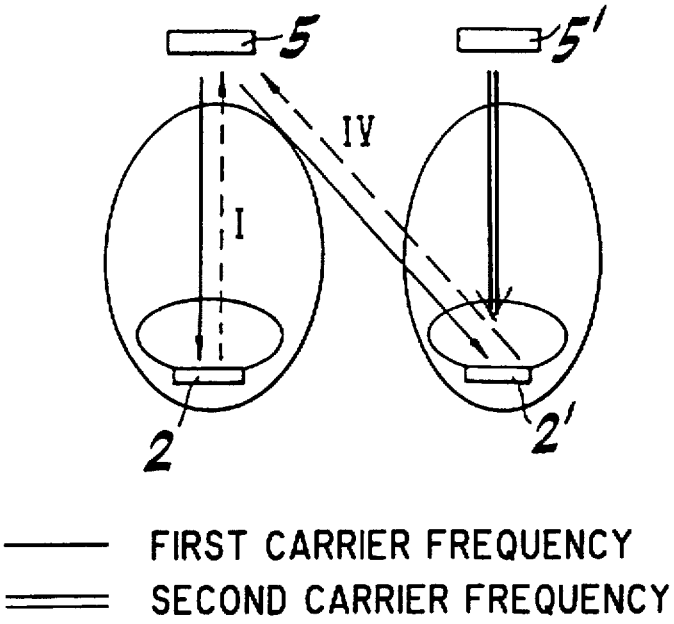
FIG. 4*b* shows radiation regions for two transmitter/receiver antennas with possible error influences when using different carrier frequencies.

FIGS. 4*a* and 4*b* show two adjacent antennas 5, 5' of a stationary station 3. They communicate with two transmitters/receivers 2, 2' in vehicles 1. The antennas 5, 5' each define a radiation region 18, 18' in the form of a major lobe, the major lobes of the transmission parts 6 and reception parts 7 being identical and multiplying each other in their action. The directional effect of the transmitters/receivers 2, 2' is slight in order to assure a desirable freedom for the arrangement of the transmitters/receivers 2, 2' in the vehicles 1.

The communication of information between the antenna 5 and the transmitter/receiver 2 takes place over the path I. Possible disturbing effects are produced by reception of signals sent out by the adjacent antenna 5' and sent back by an adjacent transmitter/receiver 2' over the paths II and III in FIG. 4*a*. While the damping via the reception profile of the antenna 5 is effective on the path II, practically no damping takes place on the path III if the signal sent back by the transmitter/receiver 2' is reflected by a reflector 19 in the direction towards the antenna 5 within the radiation region 18 of the antenna 5.

The disturbing influences on the paths II and III in FIG. 4*a* occur only with slight probability and therefore only rarely have any effect.

Such effects can be avoided if the adjacent antenna 5' radiates on a different carrier frequency which is not forwarded for evaluation by the reception part 6 of the antenna 5. In this case, a disturbance by an adjacent transmitter/receiver 2' is possible only over the path IV (in FIG. 4*b*) on which the signal sent out by the antenna 5 is reflected by the adjacent transmitter/receiver 2' to the reception part 7 of the antenna 5. Since the side-lobe reduction of the antenna 5 is effective for the transmission as well as for the reception on the path IV, a disturbance influence on the path IV is sufficiently damped in order to avoid any practical effect. The use of different frequencies for adjacent antennas 5, 5' therefore considerably reduces the probability of the occurrence of errors.

What is claimed is:

1. A method for providing a wireless exchange of data between a stationary station and at least one transmitter/receiver disposed on at least one respective object moving relative to the stationary station, the method comprising the steps of:

(a) setting a transmission profile for each of a plurality of transmitting antennas at the stationary station determined by a vectorial weighing process using a beam-forming network and controlled by a processor;

(b) setting a reception profile, under the control of the processor, for each of a plurality of receiving antennas at the stationary station corresponding to a respective one of the transmitting antennas, the reception profile for each of the plurality of receiving antennas corresponding to the transmission profile of the respective one of the plurality of transmitting antennas;

(c) transmitting, from each of the plurality of transmitting antennas at the stationary station, an original signal to a respective one of the at least one transmitter/receiver using the transmission profile, the transmission profile creating a damping effect on the original signal, producing a damped original signal;

(d) transmitting, in response to the damped original signal, a reply signal from the at least one transmitter/receiver, the reply signal having a carrier frequency and level which are equal to a carrier frequency and level, respectively, of the damped original signal; and (e) receiving the reply signal by at least one of the plurality of receiving antennas at the stationary station using the reception profile, creating a damping effect on the reply signal;

wherein the damping effect on the original signal and the damping effect on the reply signal are multiplicative in effect.

2. The method according to claim 1, wherein step (a) includes the steps of transmitting a first original signal from one of the plurality of transmitters at a first carrier frequency, and transmitting a second original signal from an adjacent one of the plurality of transmitters at a second carrier frequency, and wherein the method further comprises the step of discarding any reply signal received at one of the plurality of receiving antennas corresponding to the one of the plurality of transmitting antennas when said any reply signal is not received at the first carrier frequency.

3. The method according to claim 2, wherein the plurality of transmitting antennas includes at least four transmitting antennas, and each of the at least four transmitting antennas transmits at a different carrier frequency.

4. A system for providing a wireless exchange of data, the system comprising:

(a) a stationary station including at least one processor and a plurality of antenna arrays, each of the plurality of antenna arrays including a plurality of transmitting antennas and a plurality of receiving antennas, each of the plurality of transmitting antennas corresponding to a respective one of the plurality of receiving antennas, each of the plurality of transmitting and receiving antennas including a beam-forming network, the at least one processor setting a transmission profile of each of the plurality of transmitting antennas corresponding to a reception profile of each of the plurality of receiving antennas, each of the plurality of transmitting antennas transmitting a signal using the transmission profile set by the at least one processor, the transmission profile creating a damping effect on the signal, producing a damped signal; and (b) at least one transmitter/receiver located on at least one respective object moving relative to the stationary station, the at least one transmitter/receiver receiving the damped signal and transmitting, in response to the signal, a reply signal, the reply signal having a carrier frequency and level, respectively, of the damped signal, at least one of the plurality of receiving antennas receiving the reply signal using the reception profile, the reception profile creating a damping effect on the reply signal;

wherein the damping effect on the signal and the damping effect on the reply signal are multiplicative in effect.

5. The system according to claim 4, wherein each of the plurality of transmitting antennas is controlled by a respective processor of the at least one processor and is arranged adjacent to its respective one of the plurality of receiving antennas, the respective one of the plurality of receiving antennas also being controlled by the respective processor of the at least one processor.

6. The system according to claim 5, wherein a signal transmitted from one of the plurality of transmitters is at a first carrier frequency, and a signal transmitted from an adjacent one of the plurality of transmitters is at a second carrier frequency.

7. The system according to claim 5, wherein the at least one object includes a plurality of vehicles traveling in respective lanes of a road.

* * * * *